United States Patent [19]

Cockrell

[11] 4,437,516

[45] Mar. 20, 1984

[54] COMBINATION RELEASE MECHANISM FOR DOWNHOLE WELL APPARATUS

[75] Inventor: Darryl W. Cockrell, Houston, Tex.

[73] Assignee: Baker International Corporation, Orange, Calif.

[21] Appl. No.: 270,085

[22] Filed: Jun. 3, 1981

[51] Int. Cl.[3] ..... E21B 33/12; E21B 23/00

[52] U.S. Cl. ..... 166/120; 166/182; 166/124; 166/134

[58] Field of Search ..... 166/120, 138–140, 166/237, 123, 124, 181, 182, 143; 277/34

[56] References Cited

U.S. PATENT DOCUMENTS

| | | | |
|---|---|---|---|
| 3,189,095 | 6/1965 | De Rochemont | 166/120 |
| 3,288,219 | 10/1966 | Young et al. | 166/120 |
| 3,659,647 | 5/1972 | Brown | 166/120 |
| 3,976,133 | 8/1976 | Allen | 166/182 |
| 4,216,827 | 8/1980 | Crowe | 166/120 |

*Primary Examiner*—James A. Leppink
*Assistant Examiner*—Hoang C. Dang
*Attorney, Agent, or Firm*—Norvell & Associates

[57] ABSTRACT

A well packer or other downhole tool is provided with a combination shear and rotational release mechanism comprising a release member having a set of internal threads selectively engageable with a predetermined number of external threads formed on an elongated tubular mandrel. The release member is keyed to the packer outer housing which in turn is cooperable with the slip and packing element assemblies. The mandrel may be selectively subjected to a predetermined upward pulling force to shear the threads on the release member or, alternatively, the mandrel may be rotated a predetermined number of turns to disengage the cooperating threads on the release member to effect release of the packer from its set position.

18 Claims, 7 Drawing Figures

COMBINATION RELEASE MECHANISM FOR DOWNHOLE WELL APPARATUS

BACKGROUND OF THE INVENTION

1. Field of the Invention

The present invention pertains to downhole tools typically used in the development of oil and gas wells for providing an annular seal and/or anchoring means between one conduit disposed in another and, in particular, the present invention pertains to a combination shear type and rotational type release mechanism for such tools.

2. Background Art

In the art of downhole tools used in the well drilling industry of the type which provide for a seal to be established in the annulus between one conduit and another in the well bore it is preferred to design such tools to have an inner elongated tubular member, sometimes referred to as the mandrel, on which are mounted sealing and anchoring mechanisms which are operated to be set in and released from the working position by effecting relative axial movement between the mandrel and the mechanism components disposed therearound. One specific type of tool of the general type discussed herein is known as a packer. Many applications of well packers require that the packer be retrieved from the well after serving its purpose or for performing certain operations on the well. In this regard it is usually necessary to effect relative axial movement between the mandrel and the associated components in a direction opposite to that which resulted in setting of the packer. To this end a number of different release mechanisms have been developed which require specific mechanical operations to be performed from the surface or by mechanisms disposed in the tubing string to which the packer is connected. For example, packer release mechanisms are known which require the exertion of an axial force on the tubing string, or rotation of the tubing string to effect operation of the release mechanism.

It has been determined that it is highly desirable in the application of well packers and the like that the option be available to the equipment operator to effect release of the packer from the set position by more than one type of releasing action. In this regard the present invention has been developed to meet a long felt need for a combination releasing mechanism for well packers and the like which is economical to manufacture and is reliable in operation. Moreover, the combination release mechanism of the present invention provides for releasing a well packer or the like from a set position by one of two relatively simple mechanical operations which can be effected by basically fundamental and easily accomplished movements of the packer mandrel.

SUMMARY OF THE INVENTION

The present invention provides an improved combination releasing mechanism for a downhole retrievable tool such as a well packer or the like wherein the packer may be selectively released from the set or working condition by effecting axial movement of the mandrel to cause the failure of a frangible member interconnecting the mandrel and the anchoring, sealing and setting assemblies, or by effecting rotation of the mandrel with respect to these mechanisms.

In accordance with the present invention there is provided a well packer or the like having an elongated mandrel which is coupled to an outer housing, including radially movable anchoring and sealing members, by mechanism which provides for release of the anchoring and sealing members by either effecting relative rotation between the mandrel and the outer housing components or by axially pulling the mandrel to effect failure of a frangible shear sleeve interconnecting the mandrel and the outer housing.

In one preferred embodiment of the present invention an externally threaded portion is provided on the mandrel adjacent the lower end thereof and which is adapted to be theadedly engaged with a sleevelike member having cooperating internal threads as well as external threads which are engageable with a nut. The nut may be nonrotatably secured to the packer outer housing after being selectively positioned with the sleeve member on the mandrel. In the setting operation of the packer the sleeve member prevents relative axial movement between the mandrel and one member of the housing but, upon exertion of a predetermined axial force in excess of the forces experienced during the setting operation, the internal threads on the sleeve member are sheared to permit axial movement of the mandrel to effect release of the packer from its working position. The aforementioned abutment or nut member is also nonrotatably secured to the outer housing in a manner whereby the packer may be released from the set position by merely rotating the mandrel to disengage the cooperating internal and external threads between the shear sleeve and the mandrel.

The present invention also provides a unique combination rotation or shear type release mechanism for a well packer wherein the shear sleeve and a cooperating nut or abutment member adapted to interconnect the shear sleeve and the outer housing are provided as separate elements thereby simplifying the manufacture and selective testing of the shear sleeve material to determine the ultimate shear strength thereof. Alternatively, the shear member and the nut may be formed as a single part.

Those skilled in the art will appreciate that the improved release mechanism for a downhole tool such as a well packer or the like in accordance with the present invention adds a degree of operating flexibility for such tools which has heretofore not been enjoyed. Those skilled in the art of well packers and the like will also appreciate that the present invention provides a mechanically simple yet reliable release mechanism which may be easily adjusted in the field prior to deployment of the packer into the well. Moreover, the combination release mechanism of the present invention provides for selecting one of two optional modes for effecting release of the packer after it has been deployed in its working position. Other advantages and superior features of the mechanically simple and reliable release mechanism of the present invention will be further appreciated upon reading the detailed description which follows in conjunction with the drawings.

DESCRIPTION OF THE PREFERRED EMBODIMENTS

Figure 1A:
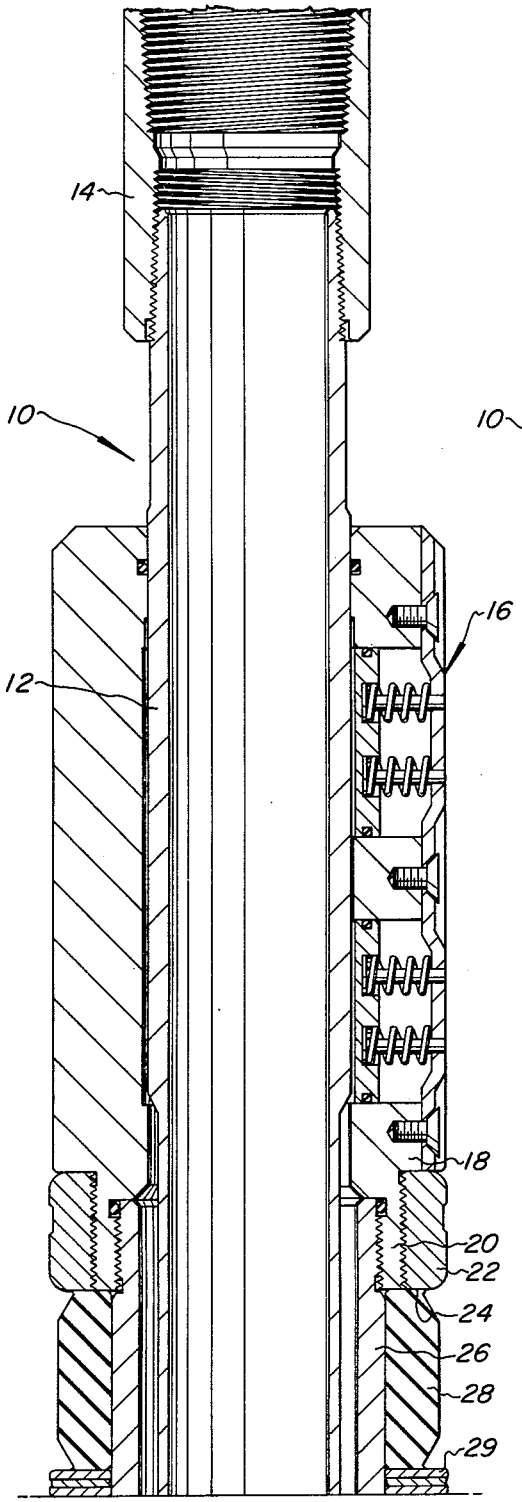
FIGS. 1A through 1C together comprise a vertical elevation view, in central longitudinal section, of a downhole well apparatus including the combination release mechanism of the present invention.

In the drawings, the figures with combined number and letter designations are intended to be viewed together arranged vertically end to end with the first letter designation, in alphabetical order, arranged as the top section of the view and the last letter designation arranged as the bottom section. In the following description the terms upper and lower are used for convenience in regards to the normal arrangement of the apparatus when it is being inserted in a generally vertically disposed well or the like. However, for some applications the apparatus may be inverted, if desired, or used in a generally horizontal or angular direction.

Figure 1B:
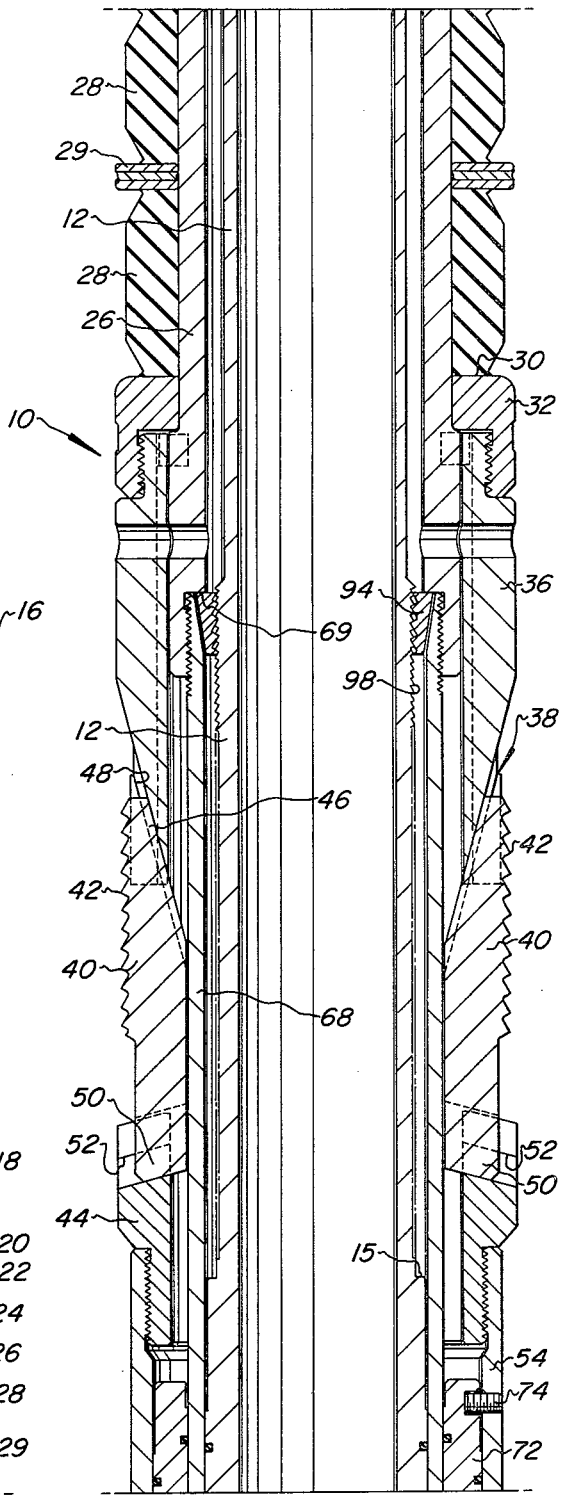
Figure 1C:
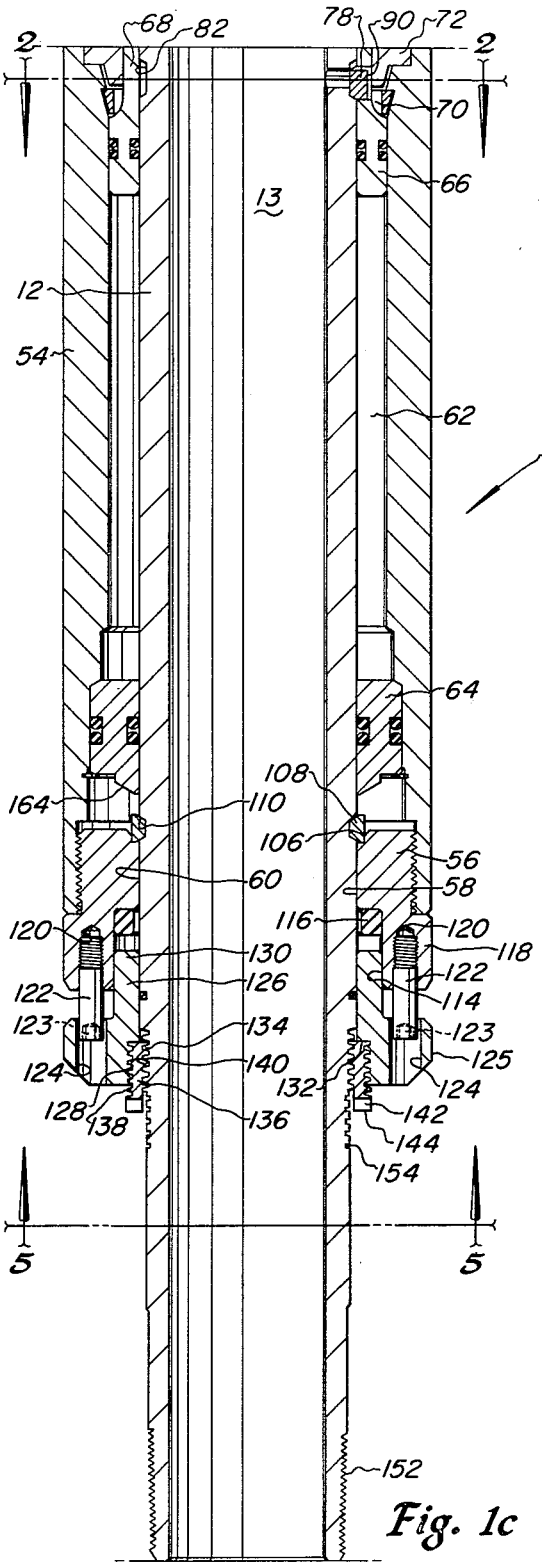

Referring to FIGS. 1A through 1C of the drawings, an apparatus embodying the present invention is illustrated and generally designated by the numeral 10. The apparatus 10 comprises a downhole tool of a type known in the art of well development as a packer and is basically adapted to provide an annular seal between concentric conduits in a well, which seal may be provided for various purposes in developing the well. Although the combination release mechanism of the present invention is advantageously used with the packer 10 it will be understood by those skilled in the art that the inventive combination may also be used with other packers as well as similar types of downhole equipment which would benefit from such an improvement.

Referring particularly to FIG. 1A, the packer 10 is characterized by an elongated inner tubular member or mandrel 12 which is threadedly coupled at its upper end to a coupling member 14. The coupling member 14 may be suitably connected to an inner conduit such as a tubing string or the like, not shown, for inserting and retrieving the packer 10 with respect to an outer conduit such as a well bore or casing, also not shown. Adjacent the upper end of the mandrel 12 is a hydraulically actuatable anchoring mechanism or holddown assembly generally designated by the numeral 16. The holddown assembly 16 is of a type known in the art of well packers and forms no part of the present invention. Accordingly, a detailed description of the component parts of the holddown assembly 16 is not believed to be necessary to gain a complete understanding of the best mode of practicing the present invention. The holddown assembly 16 includes an annular member 18 having a depending threaded portion 20 on which is disposed a gauge ring 22 having an annular downwardly facing seal urging shoulder 24. The member 18 is also threadedly connected to an elongated cylindrical sleeve 26 around which are disposed in vertically stacked relationship a plurality of resilient annular collars 28 and back up rings 29.

Referring also to FIG. 1B, the collars 28 are disposed between the downwardly facing shoulder 24 and an upwardly facing seal urging shoulder 30 formed on a second gauge ring 32. The collars 28 comprise resilient sealing elements which are responsive to relative axial movement between the members forming the shoulders 24 and 30 to be radially outwardly deformed into sealing engagement with the inner wall of the well bore or conduit, not shown, in which the packer 10 may be disposed.

Referring to FIGS. 1A and 1B the gauge ring 32 is threadedly coupled to an annular wedge member 36, referred to in the art as a slip cone, and comprising part of a slip assembly, generally designated by the numeral 38. The slip assembly 38 also includes a plurality of generally radially movable slip members 40 having transverse gripping teeth 42 formed thereon. The slip assembly 38 is of a type known in the art of downhole tools such as well packers and also forms no part of the present invention. The slip members 40 are cooperable with the wedge member 36 by way of interfitting tenon and groove portions 46 and 48 which may be of the so called T-slot or dovetail configuration. The opposite ends of the slip members 40 are also provided with dovetail tenons 50 which are fitted in cooperating slots 52 in a second wedge member 44 to provide for radial outward movement of the members 40 in response to relative axial movement between the member 44 and the member 36. The member 36 is movable axially upward relative to the sleeve 26, viewing FIG. 1B, from the limit position illustrated.

Referring further to FIG. 1B and also FIG. 1C, the slip cone or wedge member 44 is threadedly connected to an elongated cylindrical sleeve or outer housing member 54 which extends downwardly and is threadedly connected to an annular head member 56 having a bore 58 disposed in close fitting but slidable relationship to the cylindrical outer walls 60 of the mandrel 12. The housing member 54 is disposed in spaced relationship around the mandrel 12 and forms an annular chamber 62, as shown in FIG. 1C, which chamber is sealed at its opposite ends by a stationary head member 64 and a piston 66. The piston 66 is formed as an integral part of an elongated sleeve 68 which is threadedly connected at its upper end to the sleeve 26 as shown in FIG. 1B.

Referring still further to FIGS. 1B and 1C, the packer 10 is also provided with a pressure fluid chamber 70 formed between the outer housing 54, the piston 66 and a second piston 72 disposed in surrounding relationship to the sleeve member 68 and releasably secured in the position shown in FIG. 1B by one or more shear screws 74. The screws 74 are threadedly engaged with the outer housing 54 and project radially inwardly into cooperating groove formed in the periphery of the piston 72, as shown.

Figure 2:
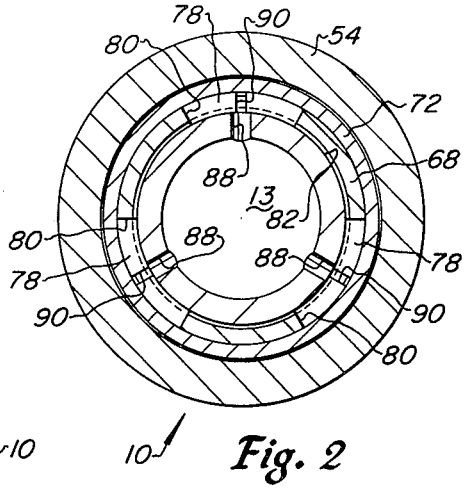
FIG. 2 is a transverse section view taken along the line 2—2 of FIG. 1C.

Referring also to FIG. 2, the piston 72 is adapted, in the position shown in FIGS. 1B and 1C, to overlie a plurality of annular segments 78 which are disposed in circular sector shaped openings 80 formed in the sleeve 68. The segments 78 also extend radially inwardly into an annular groove 82 formed in the mandrel 12. Accordingly, in the position shown in FIG. 1C and FIG. 2, the sleeve members 68 and 26 are prevented from relative axial movement with respect to the mandrel 12 by the locking segments 78. Passages 88, formed in the wall of the mandrel 12, communicate the groove 82 with the interior bore 13 of the mandrel. The segments 78 are also provided with groove portions 90 which are operable to conduct pressure fluid from the mandrel bore 13 by way of the passages 88 and the groove 82 into the chamber 70.

Figure 3:
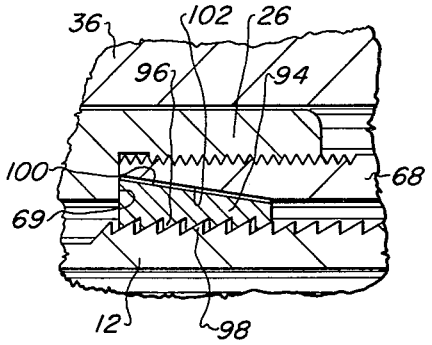
FIG. 3 is a detail section view of the cooperating wicker threads between the inner member or mandrel and a lock ring member.

Referring now to FIG. 1B and FIG. 3 the packer 10 is provided with a locking mechanism for locking the mandrel 12 with respect to the sleeve members 26 and 68 in a set position of the packer. The locking mechanism for the packer 10 is characterized by an annular wedge shaped body lock ring 94 disposed around the mandrel 12 and engaged therewith by means of respective interfitting wickers or threads 96 and 98. The lock ring 94 is of a known type which is axially split to provide for radial expansion of the ring so that it may ratchet over the wickers 98 when moved in a downward direction relative to the mandrel 12, viewing FIG. 1B. However, the configuration of the wickers 96 and 98 are such that when the ring 94 is engaged by the sleeve 68 along the cooperating surfaces 100 and 102, respectively, the lock ring is forced radially inwardly into engagement with the mandrel 12 to prevent upward movement of the sleeve 68 with respect to the mandrel, viewing FIG. 1B.

Figure 5:
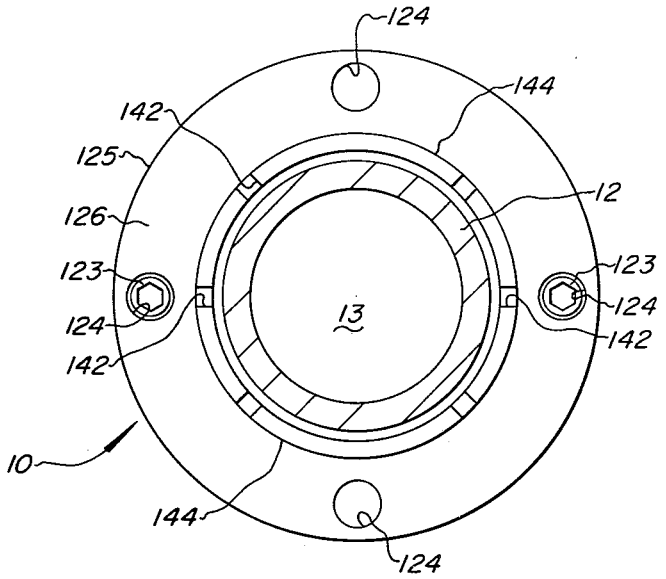
FIG. 5 is a view taken substantially from the line 5—5 of FIG. 1C.

Referring to FIG. 1C and FIG. 5, the head member 56 includes a counterbored portion 106 which is engageable with an axialy split lock ring 108 disposed in a cooperating groove 110 formed in the mandrel 12. The head 56 also includes an opposed counterbore 114 having a resilient cushioning member 116 disposed therein. The head 56 is further provided with an axially depending annular skirt portion 118 which is provided with a plurality of circumferentially spaced and axially extending tapped holes 120. The holes 120 are provided for receiving removable key members or pins 122 which are basically characterized as socket head type screws having an elongated head portion 123. The head portions 123 of the key membes extend into cooperating openings or receiving bores 124 formed in a radially extending flange 125 formed on a cylindrical nut member 126. The member 126 includes an integral upwardly extending collar portion 130 which normally extends at least partially into the counter bore 114. The cushioning member 116 is operable to be engaged by the collar portion 130 to absorb the impact loading on the member 126 when the piston 66 is actuated to set the packer 10. The member 126 also includes internal threads 128 which extend axially to an annular shoulder 132.

The mandrel 12 is also provided with threads 134 extending over a portion of the outer cylindrical surface of the mandrel in the vicinity of the nut member 126 and are adapted to be engaged by a frangible release member 136 comprising a cylindrical sleeve which includes respective external and internal threads 138 and 140 adapted to cooperate, respectively, with the threads 128 and 134. The threads 128–138 as well as the threads 134–140 are preferably of the square or Stub Acme type. The release member 136 is also provided with opposed spanner wrench slots 142 formed in the distal end 144 of the sleeve.

The release member 136 is fabricated from a suitable frangible material such as mild steel having a known shear strength. Accordingly, depending on the number of cooperating threads 134–140 in engagement, it is possible to determine the axial force necessary to effect shearing of the threads 140 to permit relative upward axial movement of the mandrel 12 with respect to the member 126 when the latter is engaged with the head 56 through the resilient collar 116.

In order to determine with some precision the shear strength of the release member 136, in use in a packer such as the packer 10, each member 136 is cut from a selected piece of material stock which has been pretested to determine with precision the ultimate shear strength of the material. Accordingly, since the axial cross-sectional area of the threads 140 may be predetermined, the force necessary to effect release of the packer may be predetermined based on the shear strength of the material and the number of threads 140 engaged with cooperating threads 134. The material for the mandrel 12 as well as the member 126 is predetermined to have a shear strength greater than that of the sleeve member 136 so that the threads sheared upon axial pulling of the mandrel 12 will be those on the sleeve member itself. The number of threads 128–138 in engagement is predetermined to be in all cases more than the number of threads 134 engaged with cooperating threads 140. In any event the engagement of the member 136 with the annular shoulder 132 prevents shearing of the threads 138 with respect to the member 126 in the usual direction of loading of the member 126 with respect to the mandrel 12. Although the member 136 is made as a separate piece for economy of manufacture of the parts 126 and 136 it may also be preferred to form the member 136 as an integral part of the nut member 126.

By providing the nut member 126 having the internal threads 138 engageable with the release member 136 the packer 10 is also adapted to be released from the set position by rotation of the mandrel 12 with respect to the nut member 126 whereby the threads 134–140 will become disengaged upon sufficient rotation to release the mandrel for axial movement with respect to the housing member 54. The "hand" of the threads 134–140 should be opposite to the hand of the threads on the cooperating members of the tubing string including the coupling member 14 and the threads on the upper end of the mandrel 12. Similarly, the threads 152 on the lower end of the mandrel 12 should be of the same hand as the threads on the upper end thereof.

When a packer 10 is prepared for insertion into a well bore or the like the axial force required to release the packer as well as the number of turns of rotation required to release may be predetermined by preselection of the number of threads 134–140 which are to be engaged between the release sleeve member 136 and the mandrel 12. Suitable indicia 154 may be provided on the mandrel 12 as indicated in FIG. 1C so that the distal end of the sleeve member 136 may be aligned with a predetermined indicia mark on the mandrel indicating the number of threads engaged and/or the axial pulling force required if, in the latter instance, the sleeve member 136 is provided of a material of predetermined and consistent shear strength.

When the sleeve member 136 has been adjusted to substantially engage the desired number of threads 134–140 the nut member 126 is then rotated together with the member 136 to align the openings 124 with corresponding spaced apart tapped holes 120 whereby the key members 122 are then inserted through the openings 124 and tightened in their respective tapped holes. A sufficient number of holes 124 may be provided, to minimize the turning of the nut member 126 so that the desired setting is substantially maintained. Typically, four holes 124 are provided so that the sleeve member 136 is only required to be moved a quarter turn from the precise desired setting. Accordingly, the packer may be optionally released by either an upward axial pulling force of predetermined magnitude on the mandrel 12 or by rotating the mandrel 12 a predetermined number of turns. Both of these operations may, of course, be relatively easy to accomplish by suitable equipment connected to the tubing string to which the packer 10 is connected, for example.

In operation to set the packer 10, the same is run to the working position in a well bore or the like on a tubing string, not shown. When the packer 10 has been run to the set position a suitable plug, not shown, is provided to close off the bore 13 below the passages 88 whereupon pressure fluid may be introduced into the chamber 70 until a sufficient pressure force is exerted on the piston 72 to shear the screws 74. The chamber 62 is sealed before insertion of the packer into the well bore and, acccordingly, the fluid pressure in the chamber 62 is essentially that of the atmospheric pressure at the surface. Accordingly, upon movement of the piston 72 sufficiently upwardly to clear the edge of the segments 78 a considerable axial force is already being exerted on the piston 66 to drive it downwardly toward the abutment 64. This axial force is sufficient to force the segments 78 radially outwardly due to the cooperating sloped annular surfaces on the segments and the sidewall of the groove 82. When the segments 78 are ejected from the groove 82 the substantial pressure differential across the piston 66 is sufficient to drive the piston rapidly towards the abutment 64 to force the slip members 40 radially outwardly into gripping engagement with the well conduit followed by continued movement of the sleeve members 68 and 26 to urge the resilient collars 28 radially outward into sealing engagement with the well conduit. As the member 68 is moved downward with respect to the mandrel 12 the annular shoulder 69, FIG. 1B and FIG. 3, engages the lock ring 94 and forces it to move downward with the members 26–68 ratcheting over the wickers 98 on the mandrel 12. When the piston 66 has reached the maximum set condition whereby a force balance is achieved between the pressure differential across the piston 66 and the deflection of the collars 28 the packer will remain in the set position due to the lock ring 94 regardless of any change in pressure across the piston.

When it is desired to release the packer from the set position described above by releasing the bridging members, the slip members 40 and the sealing collars 28, the operator has the option of exerting a predetermined upward axial force on the mandrel 12 to shear the threads 140 or rotating the mandrel 12 a predetermined number of turns to disengage the threads 134–140. Those skilled in the art will appreciate that even if the rotation mode is selected the release forces exerted by the collars 28 may effect shearing of some of the threads 140 as the mandrel is threaded out of the member 136. Furthermore, rotation of the mandrel may be accompanied by an externally applied axial force on the mandrel to effect release through a combined rotation and shear release action. When the packer is released by shearing the threads 140 or by rotation of the threads 134 out of the threads 140 the mandrel will move a short distance until the ring 108 engages a conical surface 164 on the abutment 64 whereupon the ring will be ejected from the groove 110 since it has already cleared the upper end of the head 56. As the mandrel 12 commences moving upwardly the lock ring 94 is carried the short distance between the surface 102 and the shoulder 69, which distance is sufficient to permit radial expansion of the ring to ratchet over the teeth 98 as the mandrel continues to move upward with respect to the member 68. As the mandrel 12 is moved upwardly the resilient biasing force exerted by the collars 28 urges the members 26 and 68 also upwardly so that the collars relax their sealing engagement with the well conduit. As the mandrel 12 is pulled upwardly an annular shoulder 15, FIG. 1B, eventually engages the lock ring 94 whereupon the relative movement between the mandrel 12 and the members 26–68 will cease. At this point the slip members 40 have retracted away from the well conduit and the packer may be retrieved from the well in a known way.

Figure 4:
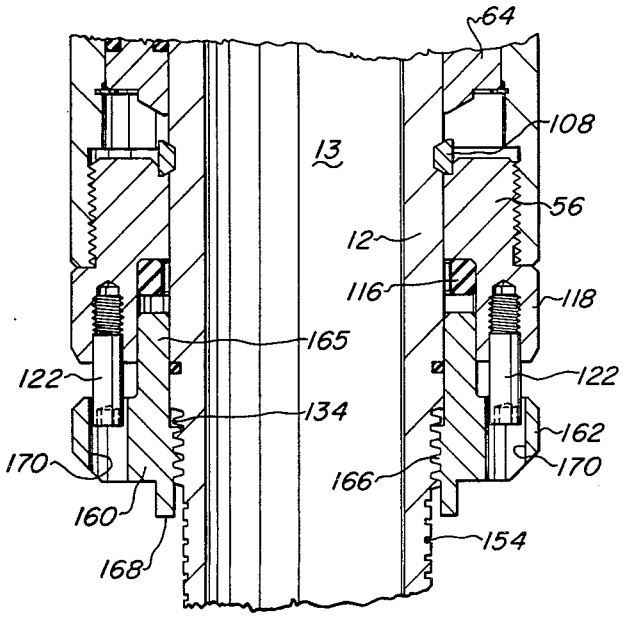
FIG. 4 is a detailed longitudinal section view of an alternate embodiment of the present invention.

An alternate embodiment of the present invention is illustrated in the detail section view of FIG. 4. Although the manufacturing cost of some materials may make it desirable to provide the nut member 126 and the release sleeve 136 as separate members it is also preferred, in some instances to manufacture the members as a single part, as illustrated in FIG. 4. In the embodiment illustrated in FIG. 4, a single unitary nut member 160 is provided having radially projecting flange portion 162 and an axially extending collar portion 165. The combination shear and rotate release member 160 includes internal threads 166 which are adapted to be engaged with the threads 134 on the mandrel 12. The release member 160 is also provided with a short axially extending rim portion 168 extending in the direction opposite to the collar portion 165. The distal end of the axial rim portion 168 is useful for aiding in accurate reading of the indicia 154 on the mandrel 12 to indicate the number of threads engaged, the axial pulling force required to release the mandrel 12 or, alternatively, the number of turns required to release the mandrel from the nut member 160. The nut member 160 is also provided with four circumferentially spaced and axially extending holes 170, two shown in FIG. 4, for receiving the key members 122. Accordingly, the combination release member 160 operates in the same manner as the arrangement illustrated in FIG. 1C and FIG. 5 but is made as a single piece as may be preferred for some packer designs.

As will be appreciated from the foregoing, the combination shear and rotational release mechanism of the present invention provides for the optional operations of either rotating the mandrel or exerting an axially upward pulling force thereon to effect release of the packer from its set position in the well. Either of these actions is conveniently accomplished in most well operations. Moreover, in the event the equipment for performing one type of release operation is not available or is inoperable for one reason or another the other procedure may be performed to effect release of the packer.

Although the present invention has been described herein in terms of one embodiment of a well packer it will be understood that this is by illustration and that the two embodiments of the combination release mechanism of the present invention are not necessarily limited to the specific packer shown or in the specific configuration disclosed as will be apparent to those skilled in the art. Accordingly, modifications to the present invention may be made without departing from the scope and spirit of the appended claims.

What is claimed and desired to be secured by Letters Patent is:

1. Apparatus for insertion in a well conduit to form a seal between said conduit and a member disposed in said conduit, said apparatus comprising:

an elongated tubular mandrel, and first and second spaced apart seal urging means disposed therearound;

resilient seal means disposed around said mandrel between said seal urging means;

at least one of said seal urging means being axially movable with respect to said mandrel and said other seal uring means to force said seal means radially outwardly into forcible engagement with said conduit; and means interconnecting said mandrel with said seal urging means, said interconnecting means including release means responsive to selective application of an axial force on said mandrel or rotation of said mandrel to effect relative movement of said mandrel to release said seal means from forcible engagement with said conduit, said release means being movable relative to said mandrel and said seal urging means to adjust the amount of axial force or rotation for effecting release of said seal means.

2. The apparatus set forth in claim 1 wherein said apparatus includes a housing member disposed around said mandrel, including a head portion, disengagable key means extending from said head portion and engageable with cooperating recess means formed on said release means to prevent rotation of said release means with respect to said head portion, said key means and said recess means being arranged such that upon disengagement of said key means said release means may be selectively rotated with respect to said mandrel and said head portion to vary the number of cooperating threads in engagement between said release means and said mandrel.

3. The apparatus set forth in claim 2 wherein said key means comprise at least one threaded pin removably mounted on said head portion and projecting into a cooperating pin bore formed on said release means.

4. The apparatus set forth in claim 3 wherein said release means includes a plurality of pin bores spaced circumferentially about a radially extending flange portion of said release means.

5. The apparatus set forth in claim 1 wherein said release means includes a tubular sleeve portion having said internal threads formed thereon, said sleeve portion being removably attachable to said release means and comprising a frangible member.

6. The apparatus set forth in claim 5 wherein said sleeve portion has a predetermined measured shear strength.

7. The apparatus set forth in claim 5 wherein said sleeve portion has a distal end extending from said release member and overlying a cylindrical outer surface of said mandrel, and said mandrel includes indicia formed on said surface for indicating the axial force required to shear said threads on said sleeve portion.

8. The apparatus set forth in claim 1 wherein said release means is rotatable relative to said mandrel and said seal urging means to adjust the amount of axial force or rotation for effecting release of said seal means.

9. The apparatus set forth in claim 8 wherein said release means is threaded relative to at least one of said mandrel or said housing, partial engagement or disengagement of said threads shifting said release means relative to at least one of said mandrel and said housing to adjust the amount of selective axial force on said mandrel or rotation of said mandrel relative to said housing to effect relative axial movement of said mandrel relative to said housing to release said seal means.

10. In a well packer including, an elongated tubular mandrel, a housing disposed around said mandrel and forming a fluid chamber, piston means disposed in said chamber and connected to an elongated sleeve, including a first downwardly facing annular shoulder, the improvement comprising:

means disposed around said sleeve and forming a second upwardly facing annular shoulder, resilient seal means disposed between said shoulders and responsive to relative movement between said sleeve and said means forming said second annular shoulder for urging said seal means into engagement with a well conduit;

lock means operable to lock said sleeve to prevent relative movement between said sleeve and said mandrel in a first direction;

a release mechanism movable relative to said mandrel and said housing to adjust the amount of axial force or rotation for effecting release of said seal means interconnecting said mandrel and said housing and operable to release said mandrel for movement with respect to said sleeve in a second direction opposite to said first direction; and said release mechanism being operable in response to the selective application of an axial force on said mandrel or rotation of said mandrel to effect relative movement of said mandrel with respect to said housing to release said seal means sufficiently whereby said packer may be retrieved from said conduit.

11. The invention set forth in claim 10 wherein said release mechanism comprises a member having internal threads formed thereon, a predetermined number of said internal threads being cooperable with mating external threads formed on said mandrel, said member being nonrotatably connected to said housing.

12. The invention set forth in claim 11 wherein said internal threads are formed on a frangible sleeve portion of said member removably connectable to said member by cooperating threads formed on said sleeve portion of said member.

13. The invention set forth in claim 11 wherein said member includes a radially extending flange portion, means interconnecting said flange portion with said housing, said means being adapted to be removed from one of said member and said housing whereby said member may be selectively rotated to engage a predetermined number of threads on said member with said threads on said mandrel.

14. The invention set forth in claim 13 wherein said means interconnecting said housing and said member comprise at least one axially projecting pin removably insertable in a transverse head portion of said housing and projecting into a cooperating pin bore on said flange portion of said member.

15. The invention set forth in claim 13, together with a cushioning member disposed on said housing and engageable with said member upon setting said packer to absorb axial loads imposed on said cooperating threads.

16. Apparatus connected to an inner conduit inserted into an outer conduit for bridging the annulus between said inner and outer conduit, comprising:

an elongated, generally tubular mandrel;

first and second urging means, axially movable relatively towards each other;

radially expandable bridging means disposed between said first and second urging means, said bridging means expanding radially outward into forcible engagement with said outer conduit as said first and second urging means move relatively towards each other; and means interconnecting said mandrel with one of said first and second urging means, said interconnecting means including combination release means responsive to selective application of an axial force on said mandrel or rotation of said mandrel to effect relative movement of said mandrel to release said bridging means for forcible engagement with said outer conduit, said release means being movable relative to said mandrel and said urging means to adjust the amount of axial force or rotation for effecting release of said bridging means.

17. The apparatus set forth in claim 16 wherein said bridging means comprise seal means.

18. The apparatus set forth in claim 16 wherein said bridging means comprise slip means.

* * * * *